US007338424B2

(12) United States Patent
Latronico

(10) Patent No.: US 7,338,424 B2
(45) Date of Patent: Mar. 4, 2008

(54) PACKAGING MACHINE

(75) Inventor: Mario Latronico, Brembate di Sopra (IT)

(73) Assignee: BG Pack S.p.a. (IT)

( * ) Notice: Subject to any disclaimer, the term of this patent is extended or adjusted under 35 U.S.C. 154(b) by 0 days.

(21) Appl. No.: 10/691,716

(22) Filed: Oct. 22, 2003

(65) Prior Publication Data

US 2004/0082457 A1 Apr. 29, 2004

(30) Foreign Application Priority Data

Oct. 25, 2002 (IT) ..... VR2002A0106

(51) Int. Cl.
*B31B 1/00* (2006.01)

(52) U.S. Cl. ..... 493/394; 493/393; 493/927; 53/133.4; 53/139.2; 53/552

(58) Field of Classification Search ..... 493/394, 493/114, 927, 393, 213, 121; 53/133.4, 139.2, 53/450, 552, 550, 568, 371.4, 371.5, 371.6, 53/374.4, 374.5, 374.6, 459
See application file for complete search history.

(56) References Cited

U.S. PATENT DOCUMENTS 3,126,682 A * 3/1964 Krance ..... 53/442
3,274,746 A * 9/1966 James et al. ..... 53/433
3,320,718 A * 5/1967 Thesing ..... 53/551
3,943,683 A * 3/1976 Kovacs et al. ..... 53/51
3,961,697 A * 6/1976 Hartman et al.
4,262,473 A * 4/1981 Brooke
4,305,240 A * 12/1981 Grevich et al.
4,618,383 A * 10/1986 Harrington
4,663,916 A * 5/1987 Ohlsson
4,876,842 A * 10/1989 Ausnit ..... 53/410
5,047,002 A * 9/1991 Zieke et al. ..... 493/394
5,322,579 A * 6/1994 Van Erden ..... 156/66
5,351,464 A * 10/1994 Francioni
5,475,964 A * 12/1995 Fiesser et al.
5,548,946 A * 8/1996 Holub
5,689,942 A * 11/1997 Suga
5,753,067 A * 5/1998 Fukuda et al.
6,122,898 A * 9/2000 De Kort
6,178,719 B1 * 1/2001 Hansen
6,523,325 B1 * 2/2003 Forman et al. ..... 53/133.4
6,625,956 B1 * 9/2003 Soudan

FOREIGN PATENT DOCUMENTS

EP 0 865 379 B1 4/2000
EP 1 106 506 A2 6/2001

* cited by examiner

*Primary Examiner*—Sameh H. Tawfik
(74) *Attorney, Agent, or Firm*—Greenberg Traurig, LLP

(57) ABSTRACT

A horizontal packaging machine (10) for making fluid-tight packages (11) equipped with zip closure (15) comprises:

at least one unit (12) for unwinding a film (13) of synthetic material for packaging a series of products (18);

at least one unit (14) for unreeling a pair of tapes (15) to form a zip closure;

a shaping tunnel (16) located downstream of the film (13) unreeling unit (12);

a sealing unit (20) located downstream of the shaping tunnel (16);

Downstream of the sealing unit (20), the machine comprises a power-driven film feed roller (21) designed to apply a uniform pulling force on the film (13) which is unwound and fed into the sealing unit (20).

9 Claims, 2 Drawing Sheets

PACKAGING MACHINE

TECHNICAL FIELD

This invention relates to a horizontal packaging machine for making fluid-tight packages equipped with zip closure.

More specifically, the invention relates to a high-speed horizontal packaging machine for packing products with a film of synthetic material to make packages with zip closure that can be re-closed.

These machines are used in the food and chemical industries to make large batches of packages ready for transportation and sale.

BACKGROUND ART

A horizontal packaging machine known in prior art comprises a supporting frame that includes a protective covering enclosing a packaging unit, a handling device for transporting the products to the end of the frame, a conveyor unit for feeding the products from the handling device to the packaging unit, and an outfeed unit for withdrawing the packaged products.

The packaging unit comprises a roller having rolled around it a film of synthetic plastic material, usually polyethylene based, that is unwound by a suitable unreeling device and wound around a shaping device or tunnel where it is sealed continuously.

The products to be packaged are fed into the shaping device or tunnel, either continuously or intermittently, and, at the same time, the sealed film is pulled off the shaping device.

At the outfeed end of the shaping tunnel, there is a sealing and cutting device which seals the film transversely to form the bottom of the package and then cuts the package off the remaining film which is still wound around the shaping device.

As the film is unwound from the roller and wound around the shaping tunnel, its two longitudinal edges are placed side by side and sealed together by a pair of heated jaws located at the shaping tunnel.

The packaging machine features electronic control circuitry for synchronising the film sealing speed with the feed speed so as to prevent the film from being pulled and stretched out of shape at the seal.

Advantageously, the packaging machine is equipped with a cutter that separates the packages from each other in such a way that the transversal seal forming the bottom of one package normally coincides with the top of the preceding package.

This is done with a quick and sure action, as described in European patent application No. EP-A-1106506.

In this patent application, the film is unwound by the combined action of an unreeling unit and two pairs of feed rollers, one downstream and one upstream of the sealing and cutting device, while a pair of tapes form a zip closure which will allow the package to be re-used after opening.

The two tapes are placed over the film just upstream of the first pair of feed rollers so that the sealing and cutting device makes a package whose zip closure is guaranteed by the adhesion of the two tapes themselves.

One drawback is that if the package is sealed continuously, the cut made to separate one package from the next may break the seal, thus causing irremediable damage to the product inside.

With regard to this problem, the aforementioned patent application provides for electronic control of the speeds of the unreeling unit and of the pair of feed rollers. Slowing and accelerating the two speeds at the film portions to be cut creates a certain discontinuity in the pair of tapes forming the zip closure, resulting in an imperfect seal.

This patent, therefore, although it overcomes some problems, is not free of disadvantages.

One disadvantage is that the use of electronic devices to control speed occupy more space and make maintenance and set up more onerous.

Another disadvantage is that the provision of numerous sources of motion, such as unreeling units and pairs of feed rollers, upstream of the sealing and cutting unit leads to frequent crumpling of the film and tapes, which in turn means extended machine downtime to rearrange the film.

DESCRIPTION OF THE INVENTION

The aim of this invention is to provide a horizontal packaging machine for making highly fluid-tight packages and which is capable of eliminating or significantly reducing the above mentioned drawbacks.

Another aim of the invention is to provide a horizontal packaging machine capable of achieving a high packaging output and significantly reducing processing time and machine down time.

This is achieved by a horizontal packaging machine for making highly fluid-tight packages.

The horizontal packaging machine for making highly fluid-tight packages according to the invention comprises:

- a unit for unreeling a film of synthetic material;
- a unit for unreeling a pair of tapes forming a zip closure;
- a shaping tunnel located downstream of the film unreeling unit;
- a sealing unit mounted downstream of the shaping tunnel and equipped with free-turning means for guiding the film;

the machine being characterised in that, downstream of the sealing unit, it comprises a power-driven film feed roller equipped with means for gripping and feeding each single package made.

According to the invention, the sealing unit comprises a pair of opposite platforms, one on each side of the forward moving film and tapes, each platform being equipped with a pair of sealing jaws and free turning film guide rollers.

Just downstream of the sealing unit, the machine further comprises a device for cutting only the pair of tapes forming the zip closure, so as to obtain portions of film, without zip closure, separating one package from the next.

Advantageously, on the outfeed side of the power-driven feed roller, the machine includes an automatic device for collecting and feeding out the finished packages at the end of the process cycle.

DESCRIPTION OF THE DRAWINGS

Other features and advantages of the invention will become evident on reading the following description of one embodiment of the invention, given as a non-restricting example, with the help of the accompanying drawings, in which.

DESCRIPTION OF PREFERRED EMBODIMENT

Figure 2:
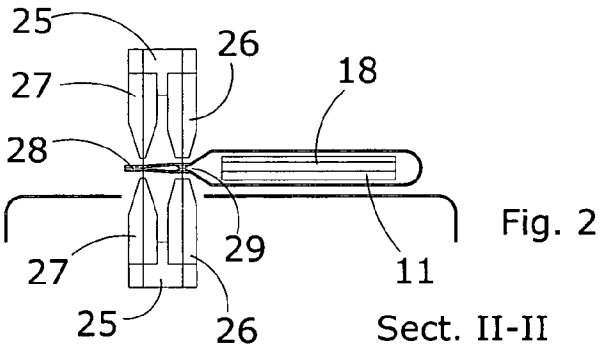
FIG. 2 is a cross section through line II-II of FIG. 1.

In the drawings, the numeral 10 denotes in its entirety a horizontal packaging machine, and in particular, a horizontal packaging machine 10 for making fluid-tight packages 11.

Figure 1:
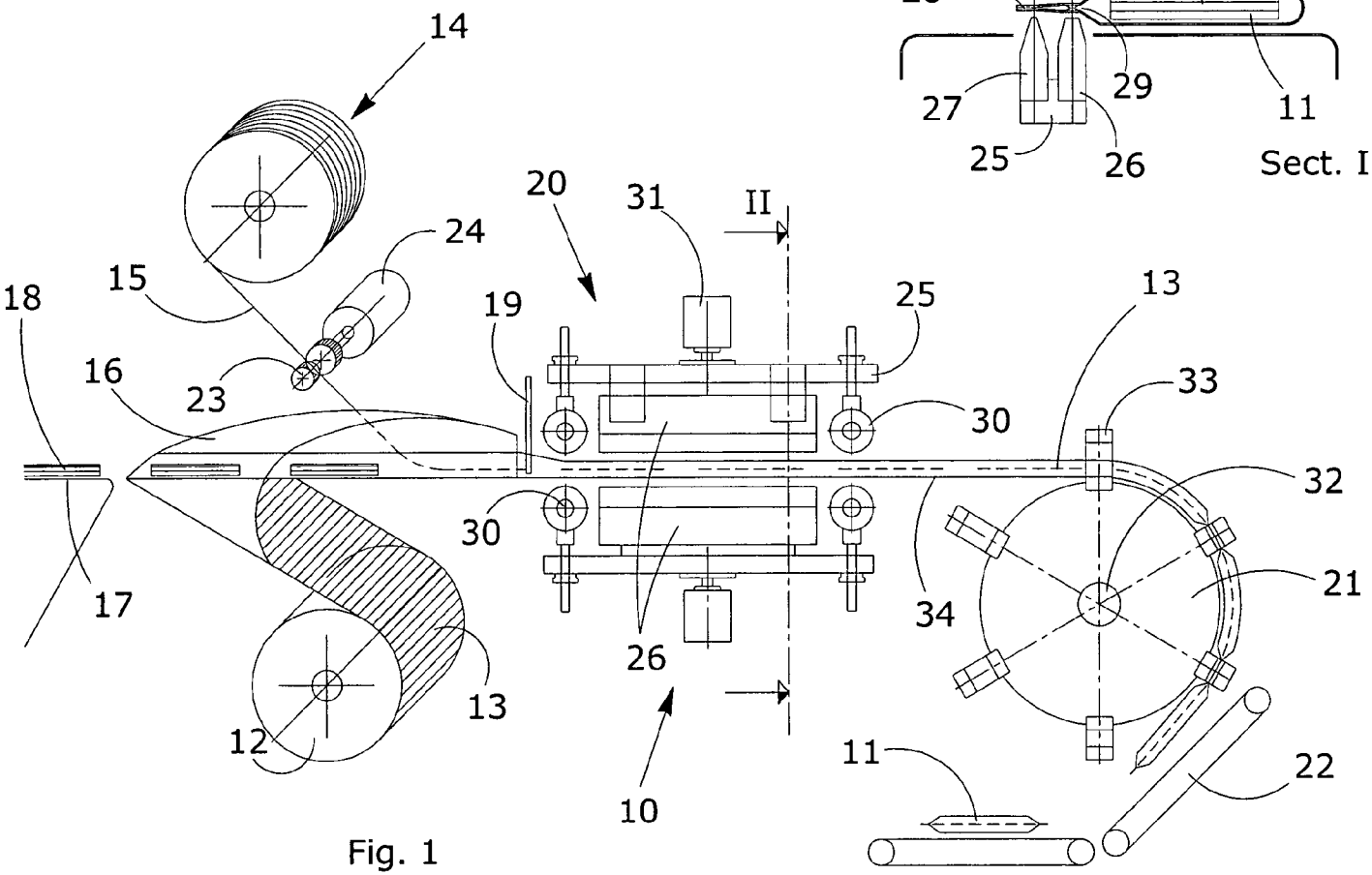
FIG. 1 is a side elevation view of a packaging machine according to the invention.

In the embodiment illustrated in FIG. 1, the machine 10 comprises:

- a roller 12 around which a film 13 of synthetic material is wound;
- a second roller 14 around which there is wound a tape 15 consisting of two paired tape portions used to make a zip closure on each package 11;
- a shaping tunnel 16 around whose surface the film 13 is trained in order to take its shape;
- a belt 17 for conveying products 18 to be packaged;
- a device 19 for cutting the zip tape 15;
- a unit 20 for sealing the film 13 longitudinally;
- a power-driven feed roller 21, mounted downstream of the sealing unit 20, designed to feed the film 13 towards a device 22 for collecting and feeding out the finished packages 11.

The rollers 12 and 14 are positioned opposite each other, on each side of the shaping device 16 so as not to interfere with the film 13 and zip tape 15 as they unwind.

The zip tape 15 is unwound by a pair of rollers 23 driven by a servomotor 24.

As shown in FIG. 2, the longitudinal sealing unit 20 comprises a pair of opposite platforms 25, one on each side of the film 13 folded around the products 18, each platform being equipped with two jaws 26 and 27. During use, the jaws 26 and 27 of one platform 25 are pressed against the respective jaws 26 and 27 of the opposite platform 25 in order to seal the package 11. More specifically, the jaws 27 apply a sealed seam 28 on the outside, designed to create a fluid-tight closure of the package 11, while the jaws 26 apply a sealed seam 29 on the inside, designed to join the zip tape 15 to the film 13.

For this purpose, the jaws 26 feature a longitudinal groove which accommodates the zip tape 15 while the seal is being made.

At the ends of each platform 25, there are free-turning rollers 30 for guiding the film 13 into the sealing unit 20.

The platforms 25 are driven by suitable sources of motion, such as, for example, linear actuators 31 fixed to each platform 25.

Film 13 feed is accomplished by the rotation of the power driven roller 21 which rotates as one with a shaft 32 driven by a suitable source of motion (not illustrated in the drawings).

The outer surface of the roller 21 has transversal sealing jaws 33 with cutting edges, preferably spaced at equal angular intervals, which close to make the transversal seal and at the same time separate each package 11 from the next by cutting the film 13 at the portion 34 without the sealed zip tape 15.

Since the parts that feed the film 13 during the process are located downstream of the unit 20, there is no risk of the film 13 and/or of the zip tape 15 being crumpled or creased since the material is kept in a stretched condition while it is sealed.

Figure 4:
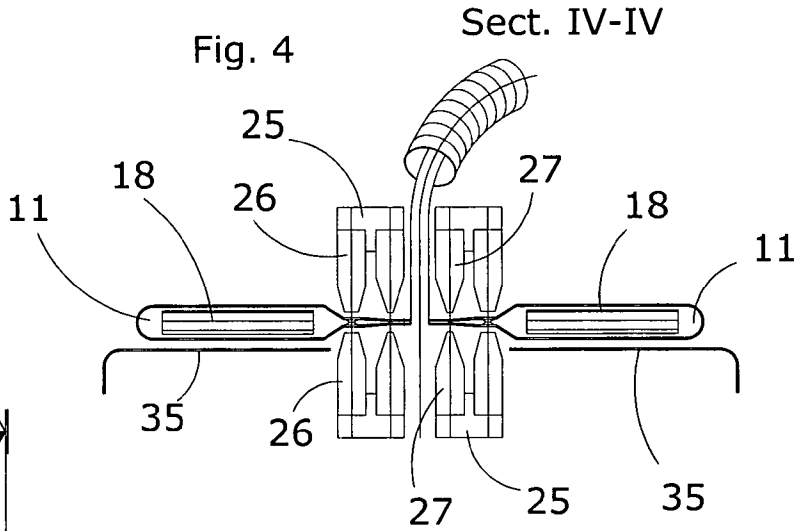
FIG. 4 is a cross section through line IV-IV of FIG. 3.
Figure 3:
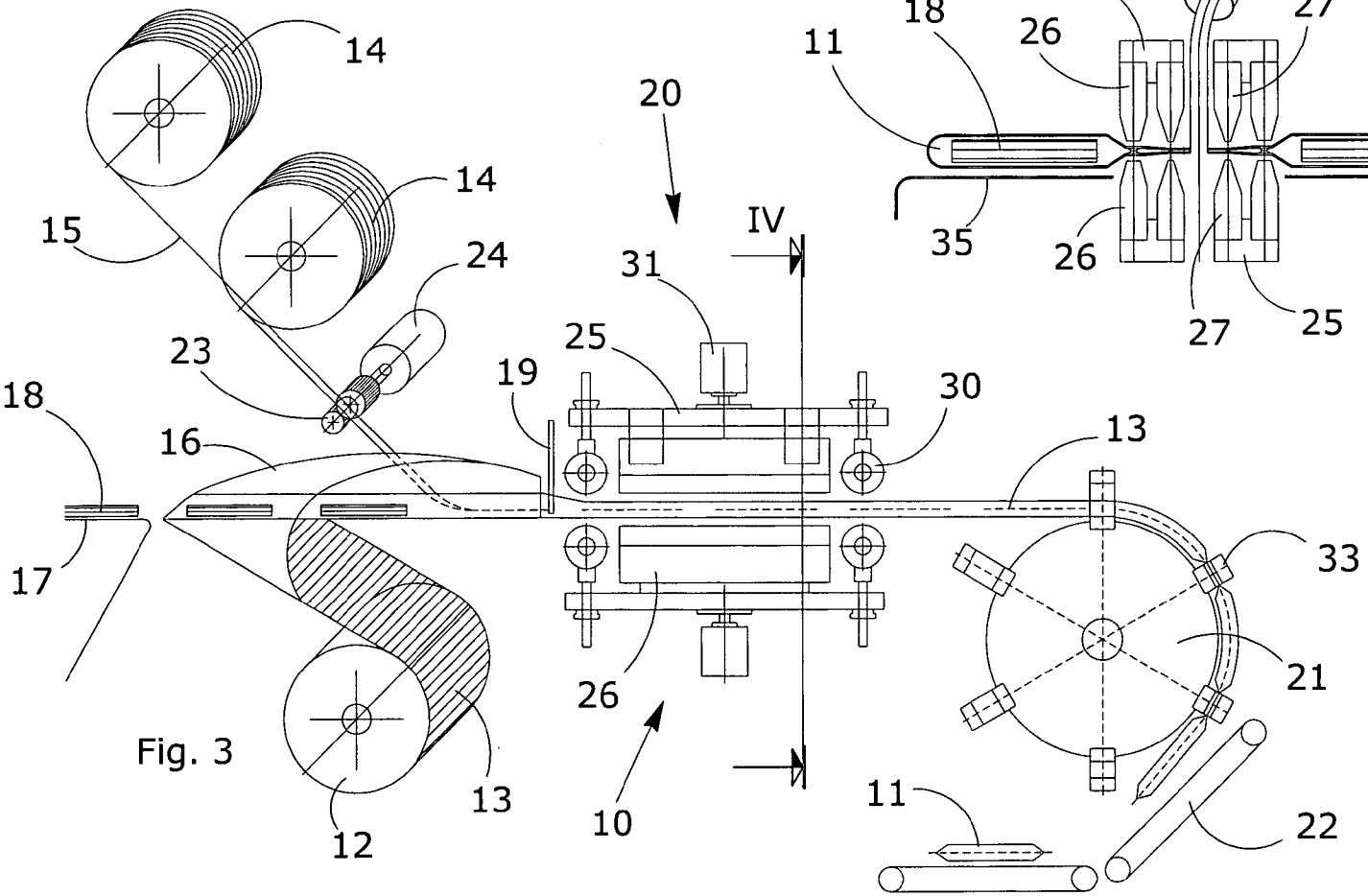
FIG. 3 is similar to FIG. 1 and shows a machine with two processing lines.

With reference to FIGS. 3 and 4, the packaging machine 10 has two process lines, placed side by side, with a single sealing unit 20 equipped with several pairs of jaws 26 and 27, to achieve higher productivity without excessively increasing the overall dimensions of the machine.

The machine according to this invention offers several advantages over similar prior art machines.

In particular, thanks to the fact that the film parts are subjected to a prolonged sealing action, a high-quality seal is obtained. Advantageously, therefore, it is not essential, as it is in prior art machines, to cut the zip tape to measure in order to prevent infiltration of air from the outside or the leakage of gas from the inside of the package.

The invention is described above with reference to a preferred embodiment of it. However, it will be understood that the invention may be modified and adapted in several ways without departing from the scope of the inventive concept.

The invention claimed is:

1. A horizontal packaging machine for making fluid-tight packages equipped with a zip closure, the machine comprising:

at least one unit for unwinding a film of synthetic material for packaging a series of products;

at least one unit for unreeling a pair of tapes to form the zip closure;

a shaping tunnel located downstream of the film unreeling unit;

a sealing unit located downstream of the shaping tunnel;

a power-driven film feed roller designed to apply a uniform pulling force on the film which is unwound and fed into the sealing unit, wherein the power-driven film feed roller is downstream of the sealing unit, wherein the location of the power-driven film feed roller and the uniform pulling force stretches the film and prevents the film from being uneven or crumpled while sealed upstream from the power-driven film feed roller and wherein the power-driven film feed roller has on its surface a series of jaws for transversely separating the packages; and a pair of opposite platforms, one on each side of the forward moving film and zip tapes, each platform being equipped with two jaws designed to make a first continuous seal along an outside of joined edges of the film and a second seal along an inside in order to attach zip tape to the film edges.

2. A machine according to claim 1, wherein the jaws have cutting edges.

3. A machine according to claim 1, further comprising a cutting device, located upstream of the sealing unit and designed to cut the zip tape in order to obtain portions of film without zip tape on.

4. A machine according to claim 1, further comprising free turning guide rollers for guiding the film into the sealing unit.

5. A machine according to claim 1, wherein one pair of jaws feature a longitudinal groove which accommodates the zip tape while the seal is being made.

6. A machine according to claim 1, further comprising, close to the at least one unit for unwinding the zip tape, a pair of unwinding rollers driven by a servo motor.

7. A machine according to claim 1, further comprising, downstream of the power-driven film feed roller, a device for collecting and feeding out the packages.

8. A machine according to claim 1, further comprising two process lines placed side by side.

9. A horizontal packaging machine for making fluid-tight packages equipped with a zip closure, the machine comprising:

at least one unit for unwinding a film of synthetic material for packaging a series of products;

at least one unit for unreeling a pair of tapes to form the zip closure;

a shaping tunnel located downstream of the film unreeling unit;

a sealing unit located downstream of the shaping tunnel wherein the sealing unit includes free turning guide rollers for guiding the film into the sealing unit;

a power-driven film feed roller designed to apply a uniform pulling force on the film which is unwound and fed into the sealing unit, wherein the power-driven film feed roller is downstream of the sealing unit and the uniform pulling force stretches the film and prevents the film from being uneven or crumpled while sealed upstream from the power-driven film feed roller, and wherein the power-driven film feed roller has on its surface a series of jaws for transversely separating the packages; and a pair of opposite platforms, one on each side of the forward moving film and zip tapes, each platform being equipped with two jaws designed to make a first continuous seal along an outside of joined edges of the film and a second seal along an inside in order to attach zip tape to the film edges.

* * * * *